US006860614B1

(12) United States Patent
Pinciaro

(10) Patent No.: US 6,860,614 B1
(45) Date of Patent: Mar. 1, 2005

(54) CHEMILUMINESCENT JEWELRY AND ACCESSORIES

(76) Inventor: Fred J. Pinciaro, P.O. Box 3130, Truth or Consequences, NM (US) 87901

( * ) Notice: Subject to any disclaimer, the term of this patent is extended or adjusted under 35 U.S.C. 154(b) by 2 days.

(21) Appl. No.: 09/992,131

(22) Filed: Nov. 15, 2001

Related U.S. Application Data

(60) Provisional application No. 60/249,404, filed on Nov. 15, 2000.

(51) Int. Cl.[7] ..... F21K 2/00

(52) U.S. Cl. ..... 362/34; 362/103; 362/104; 362/806; 362/121; 362/124; 362/807; 362/808

(58) Field of Search ..... 362/34, 103, 104, 362/806, 121, 124, 807, 808

(56) References Cited

U.S. PATENT DOCUMENTS

| | | | | |
|---|---|---|---|---|
| 2,303,988 A | | 12/1942 | Christensen | |
| 2,374,375 A | | 4/1945 | O'Donnell | |
| 2,405,384 A | | 8/1946 | White | |
| 3,576,987 A | | 5/1971 | Ridgefield et al. | 240/2.25 |
| 3,597,362 A | | 8/1971 | Bollyky et al. | 252/186 |
| 3,624,384 A | * | 11/1971 | Ledingham et al. | 362/104 |
| 3,762,092 A | | 10/1973 | Bercz et al. | |
| 3,804,307 A | | 4/1974 | Johnston | |
| 3,814,926 A | | 6/1974 | Frasca | |
| 3,968,357 A | | 7/1976 | Hamilton | |
| 3,986,144 A | | 10/1976 | Russo | |
| 4,012,629 A | | 3/1977 | Simms | |
| 4,061,910 A | | 12/1977 | Rosenfeld | |
| 4,093,973 A | | 6/1978 | Vaagenes | |
| 4,280,171 A | * | 7/1981 | Huang | 362/240 |
| 4,294,299 A | * | 10/1981 | Dorsen et al. | 150/123 |
| 4,313,843 A | | 2/1982 | Bollyky et al. | |
| 4,638,584 A | | 1/1987 | Lindsay | |
| 4,717,511 A | | 1/1988 | Koroscil | |
| 4,914,748 A | | 4/1990 | Schlotter, IV et al. | |
| 5,007,924 A | | 4/1991 | Jekel | |
| 5,018,053 A | | 5/1991 | Belknap et al. | |
| 5,117,338 A | | 5/1992 | McCrary | |
| 5,122,306 A | | 6/1992 | Van Moer et al. | |
| 5,158,349 A | | 10/1992 | Holland et al. | |
| 5,177,812 A | | 1/1993 | DeMars | |
| 5,222,797 A | | 6/1993 | Holland | |
| 5,232,635 A | | 8/1993 | Van Moer et al. | |

(List continued on next page.)

FOREIGN PATENT DOCUMENTS

| | | |
|---|---|---|
| FR | 2594328 | 2/1986 |
| WO | WO 00/04790 | 2/2000 |

OTHER PUBLICATIONS

OmniGlow™ Catalog distributed by Chemical Light, Inc., Vernon Hills, Illionois, date unknown.

Photocopy of Glowing Snownman Pins from Oriental Trading Company, Inc. catalog received Nov. 5, 2001, p. 44.

Color photographs of necklace using chemiluminescent light sticks. Purchased on Jun. 17, 2002 in Albuquerque, New Mexico. Publication date unknown. Manufacturer/owner unknown.

Color photographs of earrings using chemiluminescent light sticks. Purchased on Jun. 17, 2002 in Albuquerque, New Mexico. Publication date unknown. Manufacturer/owner unknown.

*Primary Examiner*—Stephen Husar
*Assistant Examiner*—Sharon Payne
(74) *Attorney, Agent, or Firm*—Deborah A. Peacock; Peacock Myers & Adams P.C.

(57) ABSTRACT

Accessories such as jewelry lighted with chemiluminescence. The accessories have decorative chemiluminescent article holders which utilize apertures or spaces for direct viewing of the chemiluminescent article. The accessories, may include ornamental elements back-lit by chemiluminescence.

87 Claims, 3 Drawing Sheets

U.S. PATENT DOCUMENTS 5,323,300 A 6/1994 McCrary
5,323,492 A * 6/1994 DeMars ..... 2/209.13
5,365,754 A 11/1994 Nalbandian
5,408,396 A 4/1995 Stanley
5,439,407 A 8/1995 Friedel
5,508,893 A 4/1996 Nowak et al.
5,557,869 A 9/1996 Douglas
5,615,941 A 4/1997 Shecter
5,636,421 A * 6/1997 Brams ..... 63/28
5,653,524 A 8/1997 Gray
5,690,412 A 11/1997 Sheldon
5,758,945 A 6/1998 Lima
5,876,995 A 3/1999 Bryan
6,102,555 A * 8/2000 Mizoguchi ..... 362/347
6,106,129 A * 8/2000 Cranor et al. ..... 362/34
6,340,235 B1 * 1/2002 Bryan ..... 362/156
6,431,724 B1 * 8/2002 Tedham et al. ..... 362/154
6,659,617 B1 * 12/2003 Michael ..... 362/104
6,691,533 B2 * 2/2004 Feuer ..... 63/26
2001/0017041 A1 * 8/2001 Tseng ..... 63/1.11

* cited by examiner

CHEMILUMINESCENT JEWELRY AND ACCESSORIES

CROSS-REFERENCE TO RELATED APPLICATIONS

This application claims the benefit of the filing of U.S. Provisional Patent Application Ser. No. 60/249,404, entitled "Lighted Jewelry," filed on Nov. 15, 2000, and the specification thereof is incorporated herein by reference.

BACKGROUND OF THE INVENTION

1. Field of the Invention (Technical Field)

The present invention relates to jewelry and other clothing accessories utilizing chemiluminescence for decorative lighting.

2. Background Art

This application is directed toward an improvement in typical jewelry or clothing accessory items by use of chemiluminescent materials to illuminate the accessory. Chemiluminescence has been known to exist in nature in organisms such as fireflies. Study of those naturally existing chemiluminescent organisms led to artificial chemiluminescence as described in U.S. Pat. No. 3,597,362. U.S. Pat. No. 3,576,987 went a step further to describe a now familiar chemiluminescent device that is associated with large luminescent tubes and loops often sold at fairs and parades.

Other patents have incorporated the art of chemiluminescence in some form into jewelry items. For example, U.S. Pat. No. 4,061,910 discloses use of the chemiluminescent tube in the form of a closed loop designed for use as an article of jewelry, e.g. a necklace, bracelet, or ring. The patent further discloses use of an ornamental member for jewelry pieces which can be comprised of a light-transmitting material or opaque and preferably light-reflecting material used in combination with chemiluminescence, and further describes the ornamental member as comprising a flat smooth surface, a multi-faceted surface, a curved surface of any other configuration, design or representation. The '910 patent generally describes use of a chemiluminescent tube having chambers separated by a fold which, upon releasing the fold, allow mixing of chemicals achieving chemiluminescence of the tube or use of two separate holding chambers with direct placement of the chemicals within the item to achieve the luminescence. Finally, the '910 patent describes utilization of a replaceable chemiluminescent cartridge for insertion into a channel comprising a chamber for receipt of the cartridge formed in the rigid ornamental members. The '910 device uses chemiluminescent tubes as the sole ornamental portion of the jewelry or use of chemiluminescence for illuminating an ornamental article from within.

Additionally, prior art devices include a brooch as disclosed in U.S. Pat. No. 2,374,375 and earrings as disclosed in U.S. Pat. Nos. 3,968,357 and 3,814,926 that utilize traditional incandescent light for illumination of the jewelry items. The devices are illuminated by use of lighting fixtures encased entirely or partially within the jewelry item behind transparent materials. These devices have all the drawbacks of traditional incandescent lighting: requirement of a power source, bulk, garish lighting effects, and significant heat output. This makes them inconvenient, and in the case of heat output, sometimes dangerous for use in jewelry articles.

Prior art devices do not utilize chemiluminescent sticks for dramatic lighting techniques such as back lighting or disposing the chemiluminescent element as incorporated into the ornamental design, instead of merely lighting an ornamental element. The present invention overcomes the dangerous and inconvenient properties of prior art incandescent devices while utilizing chemiluminescence for new more dramatic jewelry lighting effects.

SUMMARY OF THE INVENTION (DISCLOSURE OF THE INVENTION)

The present invention is an accessory, such as jewelry (including an earring, necklace, pendant, brooch, ring, tiara or bracelet) or other accessories such as a purse, satchel, backpack, scarf or umbrella.

The present invention is a lighted accessory having at least one decorative element comprising at least one holding element which has openings that directly display a chemiluminescent article, and a functional element having at least one attachment member for use in disposing the accessory on a wearer. Alternatively, instead of a holder with openings, the present invention may have an ornamental element.

The present invention may additionally comprise a reflective element made of metal, ceramic, or plastic which may have a finished surface that is hammered, ribbed, paneled, polished, or slightly reflective. This reflective element may have a shape that is circular, elliptical, triangular, rectangular, polygonal or irregular, and may also have a planar or three-dimensional shaped configuration.

The holding element of the present invention may be partially opaque or translucent and may have a fixed translucent area.

The accessory may have a closing member for the holding element that may comprise a tapered holder, balls, beads, or covers. Further, it may have multiple holding elements.

The accessory may comprise an ornamental element that is opaque or translucent, including semi-precious stones. The ornamental element may be back-lit by the chemiluminescent article.

A primary object of the present invention is to provide lighted jewelry and accessories with dramatic lighting effect.

Another object of the present invention is to provide safe lighting effects for Jewelry and accessories.

A primary advantage of the present invention is a safe, soft light effect for accessories.

Other objects, advantages and novel features, and further scope of applicability of the present invention will be set forth in part in the detailed description to follow, taken in conjuncton with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 4*a* is a pendant embodiment of the present invention with a reflective setting and ornamental silhouette having the chemiluminescent stick interposed between;

FIG. 4*b* is a side view of the pendant embodiment of the present invention with a reflective setting and an ornamental silhouette having the chemiluminescent stick interposed between.

DESCRIPTION OF THE PREFERRED EMBODIMENTS (BEST MODES FOR CARRYING OUT THE INVENTION)

The present invention is an improvement of jewelry and other accessories (hereinafter referred to as "jewelry" or "accessories" or "accessory") using chemiluminescence to give a decorafive or safety lighting effect to the jewelry and other accessory articles. The luminous element is incorporated into the jewelry or accessory and is either directly visible as part of the decorative scheme, or is used to create a "back-lighting" effect.

As described in the background, chemiluminescent lighting devices are known, and have progressed to include very small chemiluminescent devices which can be activated by a simple bending or twisting action. Typical devices illuminate for approximately 2 to 8 hours, but it is conceivable that a device may illuminate longer. These comparatively small devices are manufacturable in many shapes, including the familiar sticks, as well as disks, spheres, or other polygonal shapes. Additionally, there are a multitude of potential colors, including but not limited to the familiar red, orange, yellow, green, blue, and violet colors.

Figure 1A:
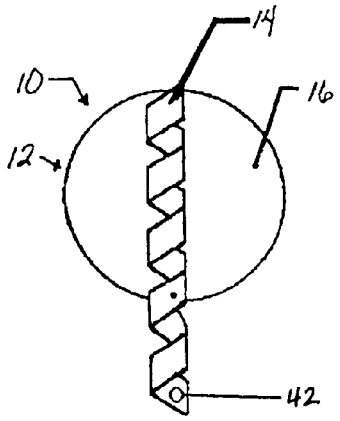
FIG. 1*a* is a perspective view depicting an earring embodiment of the present invention with a reflective setting and an ornamental member allowing direct observation of the chemiluminescent stick.
Figure 1B:
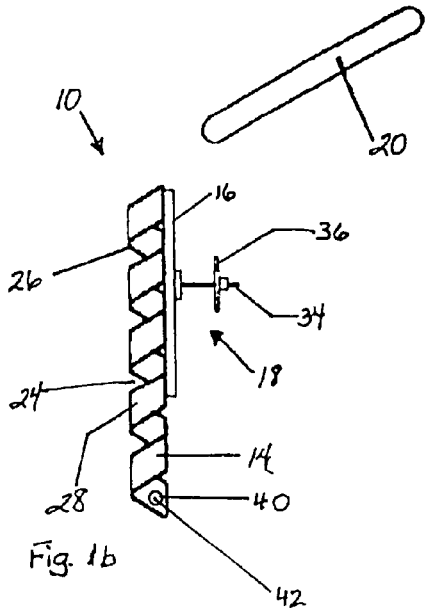
FIG. 1*b* is a side view of an earring embodiment of the present invention depicting insertion of the chemiluminescent stick.

Turning now to the figures, FIGS. 1*a* and 1*b* depict a preferred earring embodiment of the present invention utilizing direct visibility of the chemiluminescent device as a part of the ornamentation. Earring 10 comprises decorative element 12 comprising holding element 14, reflective element 16, and functional element 18.

Holding element 14 is configured for receipt of chemiluminescent element 20. Stick shape 22 of chemiluminescent element 20 is preferred in this embodiment. Holding element 14 preferably extends for the full length of chemiluminescent element 20 and at least partially surrounds chemiluminescent element 20, but alternate embodiments may comprise holding element 14 wherein the element extends only partially along the length of chemiluminescent element 20 or even beyond chemiluminescent element 20, especially in embodiments utilizing stick configuration 22 of chemiluminescent element 20. Preferably, holding element 14 comprises a configuration such as a twisted or coiled material leaving spaces 24 between twists 26 or coils 28 of the material, or a material utilizing cutouts 30 (See FIG. 2) leaving apertures 32 within the material allowing direct observation of chemiluminescent element 20.

Additionally, a preferred embodiment includes reflective setting 16 disposed behind holding element 14 which directs the chemiluminescent light toward an observer. Reflective setting 16 preferably comprises a metal, ceramic or plastic material, but may comprise any material suitable for jewelry use (i.e., not harmful for skin contact), which has an at least slightly reflective surface. Reflective surfaces may be highly polished or only slightly reflective depending on the desired effect. The surface, in addition to being at least somewhat reflective, may be textured (e.g. hammered, ribbed, paneled, etc.) or smooth. Reflective setting 16 may be of any shape or configuration (e.g. circular, elliptical, triangular, rectangular, polygonal, irregular, etc. and flat or three-dimensional).

Earring 10, as depicted in FIG. 1*b*, preferably additionally comprises functional element 18. Functional element 18 contains all necessary elements for use. For example, earring 10 depicted in FIG. 1*b*, includes functional element 18 comprising post 34 and earring back 36.

Figure 2:
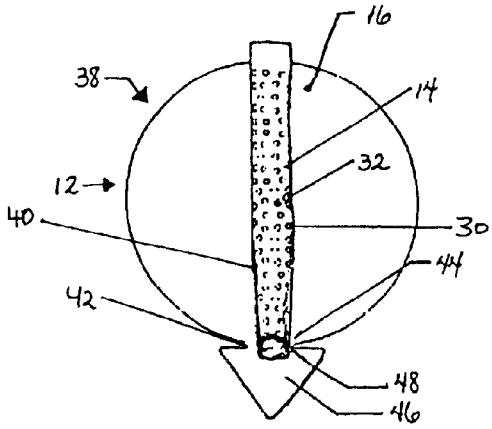
FIG. 2 is a perspective view depicting a brooch embodiment of the present invention with a reflective setting and a perforated ornamental member.

FIG. 2 depicts a brooch embodiment of the present invention utilizing direct observation of the chemiluminescent device. Brooch 38 comprises decorative element 12 comprising holding element 14 and reflective element 16, and functional element 18.

Holding element 14 is configured for receipt of chemiluminescent element 20. Stick shape 22 of chemiluminescent element 20 is depicted in this embodiment. However, holding element 14 may comprise different shapes for receipt of chemiluminescent element 20 in alternate embodiments, e.g. sphere-shaped, disc-shaped, or other polygonal shapes, etc. Holding element 14 preferably comprises either spaces 24 between twists 26 or coils 28 of the material comprising holding element 14, or cutouts 30 leaving apertures 32 within the material allowing direct observation of chemiluminescent element 20. Additionally, holding element 14 of all embodiments may additionally comprise closing mechanism 40. Closing mechanism 40 may utilize any simple mechanical device known in the art capable of safely containing chemiluminescent element 20 within holding element 14 while the jewelry item is being worn. For example, when holding element 14 is configured for receipt of stick configuration 22 of chemiluminescent element 20, the bottom of holding element 14 may be narrowed to serve as closing mechanism 40, preventing chemiluminescent element 20 from sliding through and falling out of holding element 14. Other embodiments may include other closing mechanisms 40, including but not limited to beads or balls disposed within base 44 of holding element 14 or cover 46 disposed over end 48 of base 44.

In alternate embodiments, multiple holding elements 14 may be utilized for use of multiple chemiluminescent elements 20, or a single holding element 14 may have a sufficient volume to contain multiple chemiluminescent elements 20.

Figure 3A:
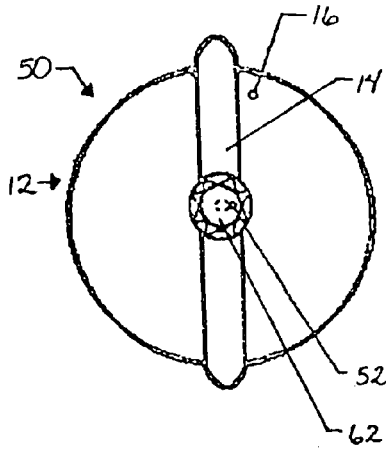
FIG. 3*a* is a perspective view of a pendant embodiment of the present invention with a reflective setting and a gem setting aperture.
Figure 3B:
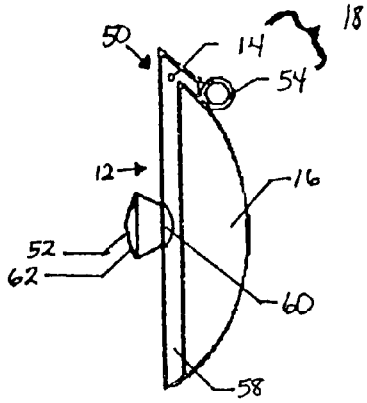
FIG. 3*b* is a side view of a pendant embodiment of the present invention with a reflective setting and a gem setting aperture.

FIGS. 3*a* and 3*b* depict a pendant embodiment of the present invention utilizing chemiluminescence for fixed, direct lighting of a translucent ornamental element. Pendant 50 comprises decorative element 12 comprising ornamental element 52 and reflective element 16, and functional element 18 comprising holding element 14 and bail 54.

As depicted in FIG. 3*b*, functional element 18 comprises holding element 14 and bail 54. Ball 54 is preferably attached to the top of holding element 14 or disposed on an upper surface of reflective element 16 utilized for attachment to chain 56 for displaying pendant 50 by hanging from the neck of a user. Holding element 14 is configured for receipt of chemiluminescent element 18. Holding element 14 preferably comprises an opaque casing 58 having a translucent portion 60 corresponding to placement of a semi-precious stone 62 in relation to translucent portion 60 and allowing light to transmit through ornamental element 52. Translucent portion 60 includes embodiments utilizing transparent portion 60, and embodiments wherein casing 58 is comprised entirely of translucent material, including embodiments utilizing transparent material. Translucent portion 60 may be comprised of any material commonly used in the chemiluminescent industry to allow transmission of light.

As seen in FIG. 3*a*, decorative element 12 comprises ornamental element 52 and reflective element 16. Preferably, holding element 14 is disposed between and connected to ornamental element 52 and reflective element 16. Ornamental element 52 preferably comprises semi-precious stone 62. Semi-precious stone 62 includes all man-made or natural semi-precious stones and reasonable facsimiles, e.g. cubic zirconia, etc. In alternate embodiments, ornamental element 52 may comprise decorative shapes with some degree of translucence to allow light to shine through. Further embodiments will utilize an opaque ornamental element 52 wherein translucent portion 60 of holding element 14 will preferably be larger or comprise entire holding element 14 to allow greater light transmission to sufficiently back-light ornamental element 52. It is preferred that reflective element 16 be utilized when an opaque ornamental element 52 is used. However, embodiments utilizing chemiluminescent back-lighting of an ornamental element without use of reflecting element 16 are envisioned. Further, use of reflective element 16 in conjunction with non-opaque ornamental elements 52 is also within the scope of the invention.

Figure 4A:
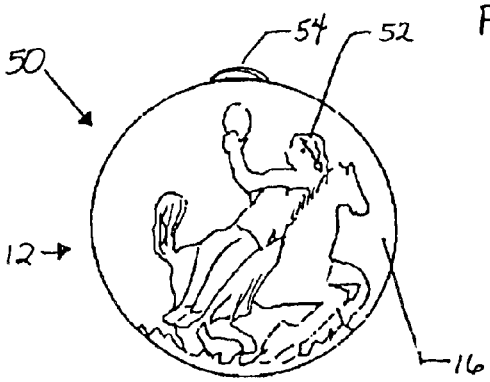
Figure 4B:
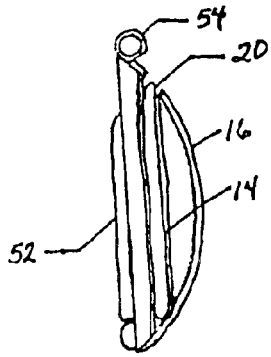

FIGS. 4*a* and 4*b* depict a pendant embodiment of the present invention utilizing chemiluminescence for back-lighting an opaque ornamental element 52. Pendant 50 comprises decorative element 12 comprising ornamental element 52 and reflective element 16, and functional element 18 comprising holding element 14 and bail 54.

Figure 5A:
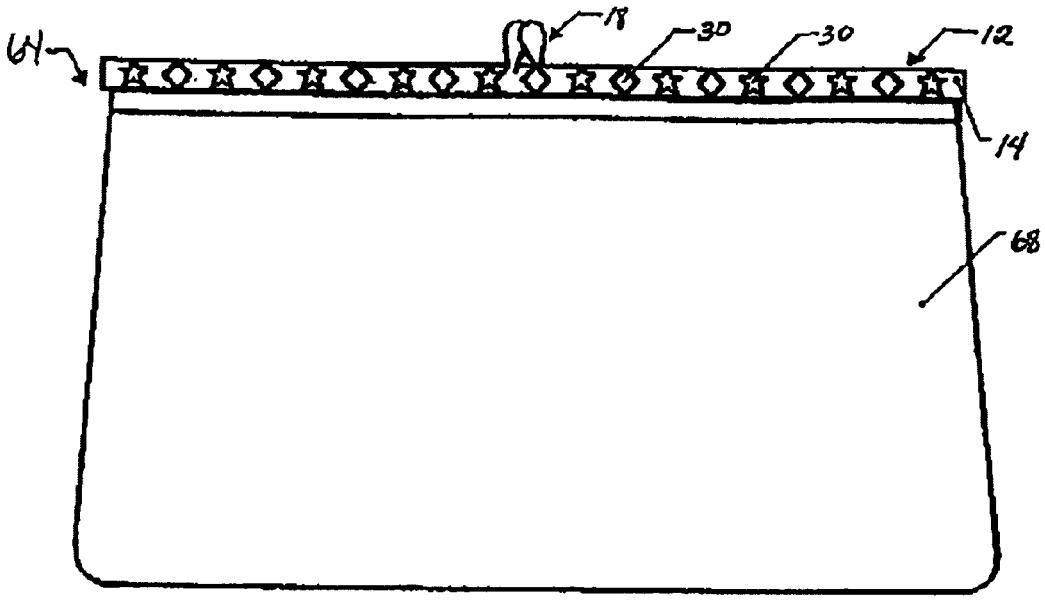
FIGS. 5*a* and 5*b* depict a purse embodiment of the present invention utilizing a perforated upper clamp as an ornamental member.
Figure 5B:
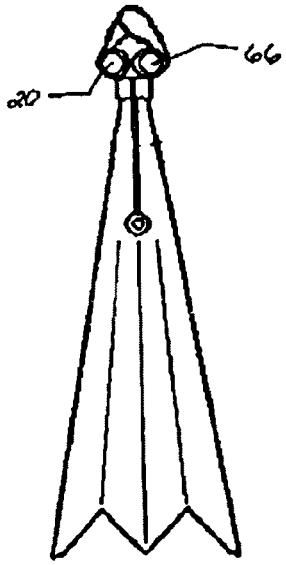

FIGS. 5*a* and 5*b* depict a purse embodiment of the present invention utilizing direct visibility of the chemiluminescent device as a part of the ornamentation. Purse 64 comprises a decorative element 12 comprising holding element 14 and functional element 18.

Holding element 14 of the preferred embodiment comprises a tubular upper purse frame 55. A cylindrical frame utilizing a circular opening is depicted, however various shaped cylinders are envisioned (e.g., triangular, rectangular, elliptical, and polygonal). Purse frame 66 further comprises cutouts 30 leaving apertures 32 within the material allowing direct observation of chemiluminescent element 20. Purse 64 further comprises functional elements 18 including a clasp disposed within purse frame 60 and the purse body 68 attached to a lower surface of purse frame 65. Further embodiments would include use of the other decorative or functional frame locations of purses or other accessories (e.g., backpacks, satchels, scarf, shoe clips, umbrella handles, and the like).

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A lighted accessory for a wearer comprising:

at least one decorative accessory element comprising at least one holding element comprising an end for receipt of a disposable and replaceable chemiluminescent article, a main body; and at least one closing member comprising a tapered holder;

at least one chemiluminescent article disposable and replaceable by the wearer in said at least one holding element via said end; and said main body comprising at least one opening in addition to said end directly displaying said chemiluminescent article.

2. The accessory of claim 1 wherein said decorative element additionally comprises a reflective element.

3. The accessory of claim 2 wherein said reflective element comprises at least one reflective material selected from the group consisting of metal, ceramic, and plastic.

4. The accessory of claim 2 wherein said reflective element comprises a finished surface.

5. The accessory of claim 2 wherein said reflective element comprises a configuration selected from the group consisting of a planar shape and a three-dimensional shape.

6. The accessory of claim 1 comprising multiple holding elements.

7. The accessory of claim 1 wherein said holding element comprises at least one member selected from the group consisting of a partially opaque member and a translucent member.

8. The accessory of claim 7 wherein said partially opaque member comprises a fixed translucent area.

9. The accessory of claim 1 wherein said decorative element additionally comprises an ornamental element wherein said ornamental element is selected from the group consisting of an opaque and a translucent member.

10. The accessory of claim 9 wherein said ornamental element comprises at least one semi-precious stone.

11. The accessory of claim 9 wherein said ornamental element is back-lit by said chemiluminescent article.

12. The accessory of claim 1 wherein said accessory comprises an earring.

13. The accessory of claim 1 comprising at least one article selected from the group consisting of a purse and satchel.

14. The accessory of claim 1 wherein said main body comprises multiple openings directly displaying said chemiluminescent article.

15. The accessory of claim 4 wherein said finished surface comprises a hammered surface.

16. The accessory of claim 4 wherein said finished surface comprises a ribbed surface.

17. The accessory of claim 4 wherein said finished surface comprises a paneled surface.

18. The accessory of claim 4 wherein said finished surface comprises a polished surface.

19. The accessory of claim 4 wherein said finished surface comprises a slightly reflective surface.

20. The accessory of claim 2 wherein said reflective element comprises a circular shape.

21. The accessory of claim 2 wherein said reflective element comprises an elliptical shape.

22. The accessory of claim 2 wherein said reflective element comprises a triangular shape.

23. The accessory of claim 2 wherein said reflective element comprises a rectangular shape.

24. The accessory of claim 2 wherein said reflective element comprises a polygonal shape.

25. The accessory of claim 2 wherein said reflective element comprises an irregular shape.

26. The accessory of claim 1 wherein said accessory comprises a necklace.

27. The accessory of claim 1 wherein said accessory comprises a pendant.

28. The accessory of claim 1 wherein said accessory comprises a brooch.

29. The accessory of claim 1 wherein said accessory comprises a ring.

30. A lighted accessory for a wearer comprising:

at least one decorative accessory element comprising at least one holding element comprising an end for receipt of a disposable and replaceable chemiluminescent article, a main body; and at least one closing member comprising a ball;

at least one chemiluminescent article disposable and replaceable by the wearer in said at least one holding element via said end; and said main body comprising at least one opening in addition to said end directly displaying said chemiluminescent article.

31. The accessory of claim 30 wherein said decorative element additionally comprises a reflective element.

32. The accessory of claim 31 wherein said reflective element comprises at least one reflective material selected from the group consisting of metal, ceramic, and plastic.

33. The accessory of claim 31 wherein said reflective element comprises a finished surface.

34. The accessory of claim 31 wherein said reflective element comprises a configuration selected from the group consisting of a planar shape and a three-dimensional shape.

35. The accessory of claim 30 comprising multiple holding elements.

36. The accessory of claim 30 wherein said holding element comprises at least one member selected from the group consisting of a partially opaque member and a translucent member.

37. The accessory of claim 36 wherein said partially opaque member comprises a fixed translucent area.

38. The accessory of claim 30 wherein said decorative element additionally comprises an ornamental element wherein said ornamental element is selected from the group consisting of an opaque and a translucent member.

39. The accessory of claim 38 wherein said ornamental element comprises at least one semi-precious stone.

40. The accessory of claim 39 wherein said ornamental element is back-lit by said chemiluminescent article.

41. The accessory of claim 30 wherein said accessory comprises an earring.

42. The accessory of claim 30 comprising at least one article selected from the group consisting of a purse and satchel.

43. The accessory of claim 30 wherein said main body comprises multiple openings directly displaying said chemiluminescent article.

44. The accessory of claim 33 wherein said finished surface comprises a hammered surface.

45. The accessory of claim 33 wherein said finished surface comprises a ribbed surface.

46. The accessory of claim 33 wherein said finished surface comprises a paneled surface.

47. The accessory of claim 33 wherein said finished surface comprises a polished surface.

48. The accessory of claim 33 wherein said finished surface comprises a slightly reflective surface.

49. The accessory of claim 31 wherein said reflective element comprises a circular shape.

50. The accessory of claim 31 wherein said reflective element comprises an elliptical shape.

51. The accessory of claim 31 wherein said reflective element comprises a triangular shape.

52. The accessory of claim 31 wherein said reflective element comprises a rectangular shape.

53. The accessory of claim 31 wherein said reflective element comprises a polygonal shape.

54. The accessory of claim 31 wherein said reflective element comprises an irregular shape.

55. The accessory of claim 30 wherein said accessory comprises a necklace.

56. The accessory of claim 30 wherein said accessory comprises a pendant.

57. The accessory of claim 30 wherein said accessory comprises a brooch.

58. The accessory of claim 30 wherein said accessory comprises a ring.

59. A lighted accessory for a wearer comprising:

at least one decorative accessory element comprising at least one holding element comprising an end for receipt of a disposable and replaceable chemiluminescent article, a main body; and at least one closing member comprising a bead;

at least one chemiluminescent article disposable and replaceable by the wearer in said at least one holding element via said end; and said main body comprising at least one opening in addition to said end directly displaying said chemiluminescent article.

60. The accessory of claim 59 wherein said decorative element additionally comprises a reflective element.

61. The accessory of claim 60 wherein said reflective element comprises at least one reflective material selected from the group consisting of metal, ceramic, and plastic.

62. The accessory of claim 60 wherein said reflective element comprises a finished surface.

63. The accessory of claim 60 wherein said reflective element comprises a configuration selected from the group consisting of a planar shape and a three-dimensional shape.

64. The accessory of claim 59 comprising multiple holding elements.

65. The accessory of claim 59 wherein said holding element comprises at least one member selected from the group consisting of a partially opaque member and a translucent member.

66. The accessory of claim 65 wherein said partially opaque member comprises a fixed translucent area.

67. The accessory of claim 59 wherein said decorative element additionally comprises an ornamental element wherein said ornamental element is selected from the group consisting of an opaque and a translucent member.

68. The accessory of claim 67 wherein said ornamental element comprises at least one semi-precious stone.

69. The accessory of claim 67 wherein said ornamental element is back-lit by said chemiluminescent article.

70. The accessory of claim 59 wherein said accessory comprises an earring.

71. The accessory of claim 59 comprising at least one article selected from the group consisting of a purse and satchel.

72. The accessory of claim 59 wherein said main body comprises multiple openings directly displaying said chemiluminescent article.

73. The accessory of claim 62 wherein said finished surface comprises a hammered surface.

74. The accessory of claim 62 wherein said finished surface comprises a ribbed surface.

75. The accessory of claim 62 wherein said finished surface comprises a paneled surface.

76. The accessory of claim 62 wherein said finished surface comprises a polished surface.

77. The accessory of claim 62 wherein said finished surface comprises a slightly reflective surface.

78. The accessory of claim 60 wherein said reflective element comprises a circular shape.

79. The accessory of claim 60 wherein said reflective element comprises an elliptical shape.

80. The accessory of claim 60 wherein said reflective element comprises a triangular shape.

81. The accessory of claim 60 wherein said reflective element comprises a rectangular shape.

82. The accessory of claim 60 wherein said reflective element comprises a polygonal shape.

83. The accessory of claim 60 wherein said reflective element comprises an irregular shape.

84. The accessory of claim 59 wherein said accessory comprises a necklace.

85. The accessory of claim 59 wherein said accessory comprises a pendant.

86. The accessory of claim 59 wherein said accessory comprises a brooch.

87. The accessory of claim 59 wherein said accessory comprises a ring.

* * * * *